US009845515B2

(12) United States Patent
Pedersen

(10) Patent No.: US 9,845,515 B2
(45) **Date of Patent: *Dec. 19, 2017**

(54) COVER ARRANGEMENT FOR AN APPARATUS FOR PROCESSING FUR

(71) Applicant: EIKON TECHNOLOGIES HOLDING SARL, Luxembourg (LU)

(72) Inventor: Kurt Pedersen, Vinderup (DK)

(73) Assignee: EIKON TECHNOLOGIES HOLDING SARL, Luxembourg (LU)

( * ) Notice: Subject to any disclaimer, the term of this patent is extended or adjusted under 35 U.S.C. 154(b) by 347 days.

This patent is subject to a terminal disclaimer.

(21) Appl. No.: 14/388,470

(22) PCT Filed: Mar. 20, 2013

(86) PCT No.: PCT/EP2013/055825

§ 371 (c)(1),
(2) Date: Sep. 26, 2014

(87) PCT Pub. No.: WO2013/143942

PCT Pub. Date: Oct. 3, 2013

(65) Prior Publication Data

US 2015/0052955 A1 Feb. 26, 2015

(30) Foreign Application Priority Data

Mar. 28, 2012 (DK) ..... 2012 00224

(51) Int. Cl.
*C14B 1/10* (2006.01)
*C14B 1/02* (2006.01)
(Continued)

(52) U.S. Cl.
CPC ..... *C14B 1/10* (2013.01); *C14B 1/02* (2013.01); *C14B 15/00* (2013.01); *C14B 17/00* (2013.01);
(Continued)

(58) Field of Classification Search
CPC .... C14B 1/02; C14B 1/04; C14B 1/10; C14B 17/00; C14B 17/02; C14B 17/04; C14B 17/06
See application file for complete search history.

(56) References Cited

U.S. PATENT DOCUMENTS 2,896,438 A 7/1959 Larsson
4,428,210 A 1/1984 Kraushaar
(Continued)

FOREIGN PATENT DOCUMENTS

EP 2093299 A1 8/2009
WO 9202643 A1 2/1992
(Continued)

OTHER PUBLICATIONS

International Search Report for corresponding application PCT/EP2013/055825, filed Mar. 20, 2013; dated Jun. 24, 2013.

*Primary Examiner* — Shaun R Hurley
(74) *Attorney, Agent, or Firm* — Cantor Colburn LLP

(57) ABSTRACT

An apparatus for processing the skin side of a tubular fur, including a mandrel on which the tubular fur can be drawn from a first part of the mandrel towards a second part of the mandrel, one or more scraper units, each scraping unit having at least one scraper means configured for scraping the skin side when the fur is arranged on the mandrel, and a cover including a compartment and an outlet, where the cover encloses a part of the mandrel and at least one of the scraper means in the compartment during operation, where the outlet is arranged in a bottom part of the cover, and where the cover has walls with inner surfaces configured for leading material removed from the skin side by means of the scraper means towards the bottom part.

20 Claims, 5 Drawing Sheets

(51) Int. Cl.

| | |
|---|---|
| ***C14B 15/00*** | (2006.01) |
| ***C14B 17/00*** | (2006.01) |
| ***C14B 17/02*** | (2006.01) |
| ***C14B 17/04*** | (2006.01) |
| ***C14B 17/06*** | (2006.01) |

(52) U.S. Cl.
CPC ..... *C14B 17/02* (2013.01); *C14B 17/04* (2013.01); *C14B 17/06* (2013.01)

(56) References Cited

U.S. PATENT DOCUMENTS

| | | | | |
|---|---|---|---|---|
| 4,745,782 | A | 5/1988 | Larsen | |
| 4,787,221 | A * | 11/1988 | Johansson | C14B 1/26 69/40 |
| 2013/0139560 | A1* | 6/2013 | Pedersen | C14B 1/02 69/44 |
| 2015/0218664 | A1* | 8/2015 | Pedersen | C14B 15/00 69/42 |

FOREIGN PATENT DOCUMENTS

| | | | |
|---|---|---|---|
| WO | 2011116771 | A1 | 9/2011 |
| WO | 2013056712 | A1 | 4/2013 |

* cited by examiner

COVER ARRANGEMENT FOR AN APPARATUS FOR PROCESSING FUR

TECHNICAL FIELD

The invention relates to an apparatus for processing the skin side of a tubular fur.

BACKGROUND

A skin taken from a furred animal such as a mink normally has a layer or residues of fat, tendons and/or flesh that is firmly attached to the skin side of the fur. Before the fur can be used for further processing, such layers or residues must be removed from the skin side.

For that purpose, different apparatuses for scraping the skin side of a fur are known. Such apparatuses may comprise a mandrel on which a tubular fur can be arranged with the skin side facing outwards, and one or more scraping units comprising e.g. scraping rollers where each scraping roller comprise scraping edges. By rotating the scraping rollers around each their rotation axis when in contact with the skin side of the fur on the mandrel, while the scraping units and the mandrel are moved relative to each other in the longitudinal direction of the mandrel, the above mentioned residues are removed from the skin side of the fur. These residues may be transported away from the scraping rollers by means of a suction arrangement comprising a system of pipes connected to the individual scraping units, The suction arrangement hereby removes the residues from the individual scraping unit.

WO 2011/116771 discloses a screening for a primary and a secondary scraper roller arranged to scrape the skin side on one side part of the mandrel.

However, the present way of handling the residues may result in a complex solution of handling the residues. Also, the present way of handling the residues may still result in an insufficient removal of the residues from the apparatus.

The disclosure provides an advantageous solution regarding handling of the said residues after they have been removed from the skin side of the fur.

BRIEF SUMMARY

The invention relates to an apparatus for processing the skin side of a tubular fur, which apparatus comprises:

- a mandrel on which the tubular fur can be drawn from a first part of the mandrel towards a second part of the mandrel so that the skin side of the fur faces outwards and the fur side of the fur faces inwards towards the mandrel,
- one or more scraping units, each scraping unit comprising at least one scraping means configured for scraping said skin side when the fur is arranged on the mandrel, and
- a cover comprising a compartment and an outlet, wherein said cover is configured for enclosing at least a part of said mandrel and at least one of said scraper means in said compartment during operation, wherein said outlet is arranged in a bottom part of said cover, said bottom part being arranged below said at least one scraper means, and wherein said cover comprises walls with inner surfaces configured for leading material removed from said skin side by means of one or more of said one or more scraper means towards said bottom part.

When the apparatus is in operation to scrape the skin side of the fur, the removed material may be hurled in different directions within the compartment of the cover by means of the scraping means. Some of it may drip towards the lower part of the cover, and some of it may be hurled towards and stick to the inner surfaces of the cover. Over time, the material on the surface may thus, by means of e.g. gravity, be lead towards the bottom part of the cover to the outlet.

By the present invention, several advantages may be achieved. For example, a more advantageous solution for of shielding the surrounding of the apparatus from the removed material may be achieved. Furthermore, since the cover may enclose at least a part of the mandrel and one or more scraping means in the compartment, a more controlled flow of removed material inside the cover may be achieved.

Also, a more cost efficient and/or simple apparatus may be achieved by the invention. In some known apparatuses, the outlet may be connected to a suction arrangement and a cyclone separator arranged external to the apparatus. By the present invention a separator arranged external to the apparatus may even be omitted and/or its capacity may be reduced. The reason for this may e.g. be that inner surfaces of the cover may, due to the configuration of the cover, act as effective separators that may collect the removed material and gather it at the bottom of the cover at/neat the outlet.

Also, the cover may facilitate that a more effective processing of the skin side may be achieved due to a more advantageous handling and removal of the removed material due to the cover. The reason for this may e.g. be that removed material may be kept away from the skin side due to the cover, and hence, a reduced amount of removed material may stick to the surfaces if the skin side. Thereby, a more effective scraping may be achieved. Also, the fur may after the scraping by means of the apparatus often be processed together with a liquid-absorbing granular material such as sawdust to remove residues from the skin side and/or to dry the skin side. The cover may help to reduce the amount of material sticking to the skin side after scraping, and hence a reduced amount of saw dust or the like may be utilized.

Moreover, test results have shown that the cover has a very positive effect on the apparatus with regard to reducing the amount of time that the apparatus needs to be taken out of operation due to maintenance. This is described in more details in the following. Prior art apparatuses for processing fur often need to be stopped several times per day to clean parts of the scraping apparatus. Especially moving parts of the apparatus, such as linear actuators, motor parts, parts of the scraping means and/or the like needs to be cleaned and maintained often in such apparatuses. For example, fluid controlled actuators such as e.g. pneumatic actuators arranged to move the scraping means towards and away from the mandrel needs to be cleaned several times each day in such apparatuses. Such actuators are often arranged to provide a predefined scraping pressure towards the skin side. However, material removed during scraping has a tendency to stick to parts of the scraping apparatus including the mentioned actuators and other movable parts. This influents on the moving parts of the actuators, and may e.g. result in that the scraping pressure is unintentionally reduced over time and this may result in a decreased scraping quality over time. To avoid this decreased scraping quality, cleaning and/or other maintenance of the apparatus thus needs to be performed several times each day in prior art apparatuses. After implementing a cover according to the present invention, the moving parts of the apparatus, which in prior art apparatuses was exposed to the removed material, operates much more reliably due to that significantly less material sticks to the parts.

Thus, the cover has shown to provide the effect of significantly reducing the needed maintenance time of the apparatus and a more effective removal of removed material.

It is understood that by the term "removed material" is understood e.g. residues of fat, tendons and/or flesh that is attached to the skin side before scraping.

In advantageous aspects, said apparatus may comprise a removal arrangement, said removal arrangement being configured for removing said material removed from said skin side from said bottom part.

In aspects, the said removal arrangement may comprise a pump arrangement connected to said outlet and being configured for pumping said material from said bottom part to the exterior of said cover. For example, the said pump arrangement may comprise a liquid pump, but it is understood that the pump arrangement may comprise any other suitable types of pumps in other aspects of the invention.

Since the cover may collect removed material from the skin side of a plurality of furs, and/or since that the apparatus may comprise a plurality of scraper means for removing material from the skin, a large amount of material may be needed to be transported away from the bottom part of the cover. For this purpose, a pump such as a liquid pump may be advantageous.

In aspects of the invention, the removal arrangement may comprise a suction arrangement connected to the bottom part of said cover. Preferably, the suction arrangement may be arranged to apply a vacuum to said compartment during operation. The suction arrangement may facilitate an advantageous and controlled flow of air inside the compartment so that an advantageous flow of air inside the cover may be achieved from one or more areas of the cover and towards the bottom part of the cover. This may help to force removed material towards the bottom part of the cover.

In preferred aspects of the invention, said cover may be kept in a fixed position during operation of the apparatus. As an example, the cover may e.g. be attached to a frame structure of the apparatus, and the mandrel and/or the scraping unit(s) may thus be moved in relation to the cover while the cover is kept in a fixed position. Also, in aspects of the invention where the scraping means are moved towards and away from the mandrel, the cover may still be kept in a fixed position so the scraping means are moved in relation to the cover.

However, in other aspects, at least a part of the cover may be arranged to be moved in relation to a frame structure of the cover, e.g. in the longitudinal direction of the mandrel.

Advantageously, at least one of said scraping means may comprise a scraper roller which scraper roller is arranged to be moved towards and away from said mandrel during operation, and wherein said cover comprises at least one opening allowing said scraper roller to be moved towards and away from said mandrel during operation of said apparatus.

This may be advantageous in that the scraper roller(s) may be arranged with a rotation axis that may be parallel to one or more surfaces of the mandrel. Thus, to facilitate an advantageous control of scraper units comprising such scraper rollers, it may be advantageous to allow the scraper units to be moved in relation the cover and the mandrel It is understood that the apparatus in different embodiments of the invention may comprise scraper means comprising e.g. scraper devices being arranged to rotate around a rotation axis perpendicular or substantially perpendicular to surfaces of the mandrel, so as to apply forces to the skin side in different directions. Such devices may also in aspects be at least partly enclosed in the compartment of the cover during scraping.

In aspects of the invention, said opening may comprise one or more tightening arrangements arranged for sealing a gap between said scraping unit and a wall of the cover. Such tightening arrangements may help to shield the surroundings of the apparatus from the removed material. Furthermore, the tightening arrangement(s) may help to facilitate a more controlled air flow inside the cover by means of e.g. said removal arrangement, especially in embodiments where the removal arrangement comprises a suction arrangement.

In preferred aspects of the invention, said cover may be common to scraping means of two or more scraping units of the apparatus.

Advantageously, the said apparatus may comprise at least one set of scraping means arranged on opposite sides of said mandrel, and said cover may be arranged to enclose the scraping means of at least one of said set of scraping units in said compartment.

In further advantageous aspects, said cover may be common to all scraper means of said apparatus.

The above aspects may be advantageous in that e.g. a more controlled and/or simple removal of material removed from the skin side of the fur may be facilitated.

Advantageously, said cover may comprises one or more service openings configured for allowing access to said one or more scraper means, said one or more service openings being configured for being sealed during operation of said apparatus.

Thus, easy access to the interior of the cover in relation to e.g. service on the scraper means may be facilitated. The service openings may e.g. comprise openings that allow the scraper means to be arranged inside the compartment, and/or other openings arranged to be opened by means of e.g. a gate/door that seals the opening in a closed position.

In advantageous aspects, said cover may comprise openings for allowing said mandrel to be moved in its longitudinal direction through said compartment of the cover so as to allow said scraping means to scrape said skin side of the fur.

Preferably, said inlet and outlet openings may be provided with a tightening arrangement in contact with the surfaces of the mandrel/fur during scraping so that a tight connection between the cover and the mandrel is achieved. These may furthermore help to scrape the surface of the mandrel.

In an advantageous aspect, said cover may comprise one or more ventilation openings for air, said ventilation openings being separate to one or more openings configured for allowing said mandrel to be moved in its longitudinal direction through the compartment of said cover, and/or openings for facilitating that said one or more scraper means can be arranged in the compartment of the cover.

Thus, due to the configuration of the cover, a more controlled flow of air through the cover may e.g. be facilitated by means of the said ventilation openings.

In aspects, one or more of said one or more ventilation openings may be arranged at a higher location than said scraping means. The ventilation openings may e.g. be arranged above the scraping means of a set of scraping units. Thus, a flow of air from above the scraper means past the scraper means may be facilitated. However, it is understood that the ventilation openings may be arranged at any suitable location in the cover in other aspects of the invention.

In advantageous aspects of the invention, drive means of a set of scraping units comprising scraping means arranged on opposite sides of the mandrel may be arranged on the same side in relation to the mandrel. This may e.g. allow easier access to the scraper means inside the apparatus since both scraper means of the set of scraper units may be accessed from the same side. For example, in cases where the scraper means of the apparatus needs to be exchanged. Also, a more simple and/or tight cover may be achieved by this.

Advantageously, in aspects of the invention, said bottom part may be configured for acting as a temporary storage for material removed from said skin side. Thus, the material may accumulate at the bottom part of the cover and may afterwards be removed from the cover by e.g. a removal arrangement as described in this document.

Also, in aspects of the invention, said cover may comprise a second outlet being an air outlet separate to said outlet. This may e.g. facilitate a more effective handling of the removed material.

For example, the outlet may be utilized for removing the material from the cover, e.g. by means of a pump arrangement and/or a suction arrangement of a removal arrangement e.g. as described above. The air outlet may furthermore be connected to a suction arrangement (e.g. another suction arrangement), e.g. by means of a piping system or the like, so as to facilitate an air flow towards the bottom part of the cover. This suction arrangement may help to establish a vacuum inside the cover to transport the removed material towards the bottom part. The removed material may thus be arranged at/near the outlet for the removed material to be removed from the cover.

Advantageously, the said separate air-outlet may be arranged in a wall of the cover above the outlet for the material.

In preferred aspects, the cover is a substantially closed cover enclosing at least one or more scraping means and a part of the mandrel, and the cover may be arranged to e.g. only comprise openings for the mandrel, openings for allowing the scraping means to be arranged in the casing, and/or air inlets separate to such openings, during operation.

BRIEF DESCRIPTION OF THE FIGURES

Aspects of the present disclosure will be described in the following with reference to the figures in which.

DETAILED DESCRIPTION

Figure 1:
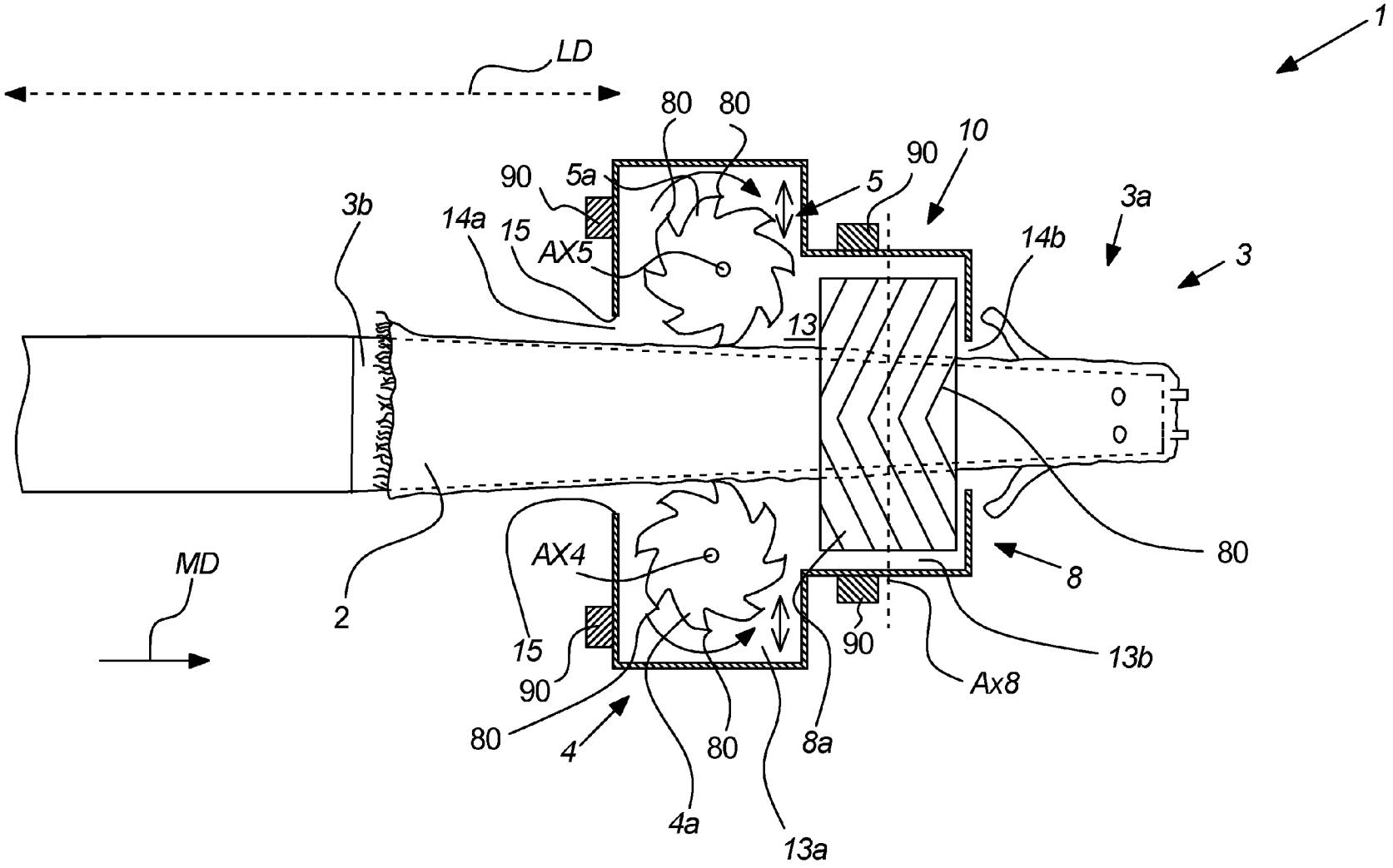
FIG. 1: illustrates the apparatus seen from the top and into the interior of a cover of the apparatus according to embodiments of the invention.

FIG. 1 illustrates an apparatus 1 for processing the skin side of a tubular fur 2, preferably a mink fur, seen from above. The tubular fur 2 comprises a fur side and a skin side. The fur 2 comprises different parts that originally, before the fur 2 was removed from the furred animal, enclosed different parts of the body of the furred animal.

The fur 2 is placed on a mandrel 3 of the apparatus 1. The mandrel comprises a first part 3*a* that is thinner than a second part 3*b* of the mandrel 3. The mandrel 3 may thus create/form a mandrel 3 with a tapered end, where the fur 2 can be drawn on the mandrel from the thin part 3*a* of the mandrel 3 towards the thicker part 3*b* of the mandrel.

The apparatus 1 preferably comprises one, two or more scraping units 4, 5, 8. Each scraping unit 4, 5, 8 comprises one or more scraping means 4*a*, 5*a*, 8*a*, such as e.g. a scraping roller. The scraper roller(s) of each of the scraping units 4, 5, 8 is arranged to rotate to apply a force to the skin side of the fur from opposite sides of the mandrel 3, preferably in a direction towards the second part 3*b* of the mandrel 3, i.e. towards the thicker part of the mandrel 3. In the present example, the apparatus comprises two sets of scraping units 4, 5, 8. The first set comprises the first scraping unit 4 comprising the scraping means 4*a* and the second scraping unit 5 comprising the second scraping means 5*a*. The second set comprises the third scraping unit 8 comprising the scraper means 8*a* and a fourth scraping unit comprising the second scraping means.

The scraping units 4, 5 of the first set are preferably arranged on opposite sides of the mandrel 3, so that the scraper means 4*a*, 5*a* scrape the skin side of the fur arranged on side surfaces of the mandrel 3 when the mandrel is moved in its movement direction.

In the present example, the scraping means 8*a* of the second set are arranged for scraping the skin side of the fur arranged on top and bottom surfaces on the mandrel. The fourth scraping means arranged to scrape the bottom surface(s) is however not illustrated in FIG. 1.

So as illustrated, the scraping means (in the present example comprising scraper rollers) of the scraping units 4, 5, 8 may be arranged to rotate around a rotation axis AX4, AX5, AX8 preferably to apply a scraping force against the movement direction MD of the mandrel 3. The first set of scraper units 4, 5 are arranged on opposite sides of the mandrel 3 so that the scraping means, e.g. scraper rollers as illustrated, of the scraper units are arranged to scrape skin that is arranged to cover the side surfaces of the mandrel 3.

The second set of scraper units 8 are also arranged on opposite sides of the mandrel 3, to scrape parts of the skin not being scraped by the scraping means of the first set. Hence, in the present example the scraper rollers of the scraper units 8 are arranged to scrape skin that cover the top and bottom surfaces of the mandrel 3.

It is to be understood that even though FIG. 1 only illustrates that the scraping units 4, 5, 8 comprises one scraping means (4*a*, 5*a*, 8*a*) each, one or more of the scraping units may in other embodiments comprise more than one scraping means each such as e.g. two scraping means or even more scraping means. So, in an embodiment, the scraping units 4, 5 and/or 8 may comprise e.g. two scraping rollers each. The scraping rollers of a scraping unit comprising two scraping rollers may e.g. being arranged with parallel rotation axes. Also, such scraping rollers may both be arranged for being rotated to apply a scraping force in a direction towards the second part 3*b* of the mandrel. In an alternative embodiment, one of the scraping rollers of a scraping unit may be arranged for being rotated to apply a scraping force in a direction towards the second part 3*b* of the mandrel, whereas another scraping roller of the same scraping unit may be arranged for being rotated to apply a scraping force in a direction towards the first part 3*a* of the mandrel 3.

The scraping means 4*a*, 5*a*, 8*a* may comprise a plurality of scraping edges 80 for scraping the skin side of the fur 2 during rotation of the scraping means and when in contact with the skin side.

I embodiments of the invention, one or more of the scraping rollers 4*a*, 5*a*, 8*a* of a scraper unit 4, 5, 8 may comprise V-shapes or substantially V-shaped scraping edges 80 as illustrated in FIG. 1. However, the scraping edges may also be straight and/or may extend in various directions in relation the intended rotation axis of the respective scraping roller.

As illustrated, the mandrel 3 may be moved in a movement direction MD that is in the mandrel's longitudinal direction LD in a direction towards the thin end 3*a* of the mandrel 3, when the apparatus 1 is in operation so that the scraping means of the scraping units 4, 5, 8 are arranged to rotate to scrape the skin surface of the fur arranged on the mandrel 3.

The rotation axis AX4, AX5 of the scraping rollers 4*a*, 5*a* of the first set of scraping units 4, 5 are in the present example arranged to be parallel to the side surfaces of the mandrel 3, while the rotation axis AX8 of the scraping rollers 8*a* of the second set of scraping units 8 may be arranged to be parallel to the top surfaces of the mandrel 3.

As illustrated, the apparatus 1 furthermore comprises a cover 10. The cover forms a compartment 13 which encloses the scraping means 4*a*, 4*a*, 8*a* of the scraping units 4, 5, 8, 9, and a part of the mandrel 3 to be scraped by the scraping means, in the compartment of the cover.

The mandrel 3 is moved along its longitudinal direction LD in the indicated movement direction MD, so that an area of the mandrel 3 corresponding to the extent of the cover 10 in the longitudinal direction of the mandrel 3 is enclosed in the cover 10. For this purpose, the cover comprises openings 14*a*, 14*b*. These openings allows the mandrel 3 to be moved in its longitudinal direction LD through the compartment 13 of the cover 10 so as to allow the scraper means 4*a*, 5*a*, 8*a*, to scrape the skin side of the fur 2 on the mandrel 3. The first opening 14*a* and the second opening 14*b* may e.g. be formed by one or more edges 15 in the walls of the cover 10.

The compartment 13 of the cover illustrated in FIG. 1 comprises two compartment sections 13*a*, 13*b*. The first compartment section 13*a*, at least during operation, encloses a part of the mandrel 3 and the scraper means 4*a*, 5*a* of the first set of scraping units for scraping skin covering side surfaces of the mandrel 3. The second compartment section 13*b*, at least during operation, encloses a part of the mandrel and the scraper means 8*a* of the second set of scraping units for scraping skin covering top and bottom surfaces of the mandrel 3.

It is understood, that in embodiments of the invention, the cover may also comprise a partition wall (not illustrated) between two abutting compartment sections of the cover. In other embodiments of the invention, the cover may, as illustrated in FIG. 1, be arranged with a free passage in the cover between abutting compartment sections without a partition wall.

It is understood that even though the cover 10 illustrated in FIG. 1 comprises a compartment 13 comprising the first and the second compartment sections 13*a*, 13*b*, so that the compartment 13 is common to all of the scraping means 4*a*, 5*a*, 8*a* of the apparatus 1, the cover 10 may in other embodiments be arranged to form a compartment 13 covering just one, two, three or four, scraping means and a part of the mandrel 3. Also, the compartment sections 13*a*, 13*b* may be divided in a different way in other embodiments of the invention.

As described above, the scraping units 4, 5, 8, 9, may in embodiments comprise one or more such as two or more scraper means. This is however not illustrated in any figure. In such embodiments, it is naturally under stood that the layout of the cover 10 may be adapted in a suitable way to allow enclosing such scraper means. For example, the size and layout of the section(s) 13*a*-13*b* may be adapted, the number and/or configuration of openings 16*a*-16*d* may be adapted, and/or the number of sections 13*a*, 13*b* may be varied.

As illustrated in FIG. 1, the cover 10 is kept in a fixed position, and both the mandrel 5 and the scraper means/scraper units may be arranged movable in relation to the mandrel. The mandrel is thus in the present example moved in its longitudinal direction LD through the compartment 13 of the cover, and the scraping means may be moved towards and away from the mandrel in the compartment 13 while the cover is kept in a fixed position. The cover 10 may thus e.g. be fixed to a support frame structure 90 of the apparatus 1. The support frame structure may e.g. be arranged to support different parts of the apparatus and may be arranged to support on the floor/ground and/or a part of a building.

Figure 2:
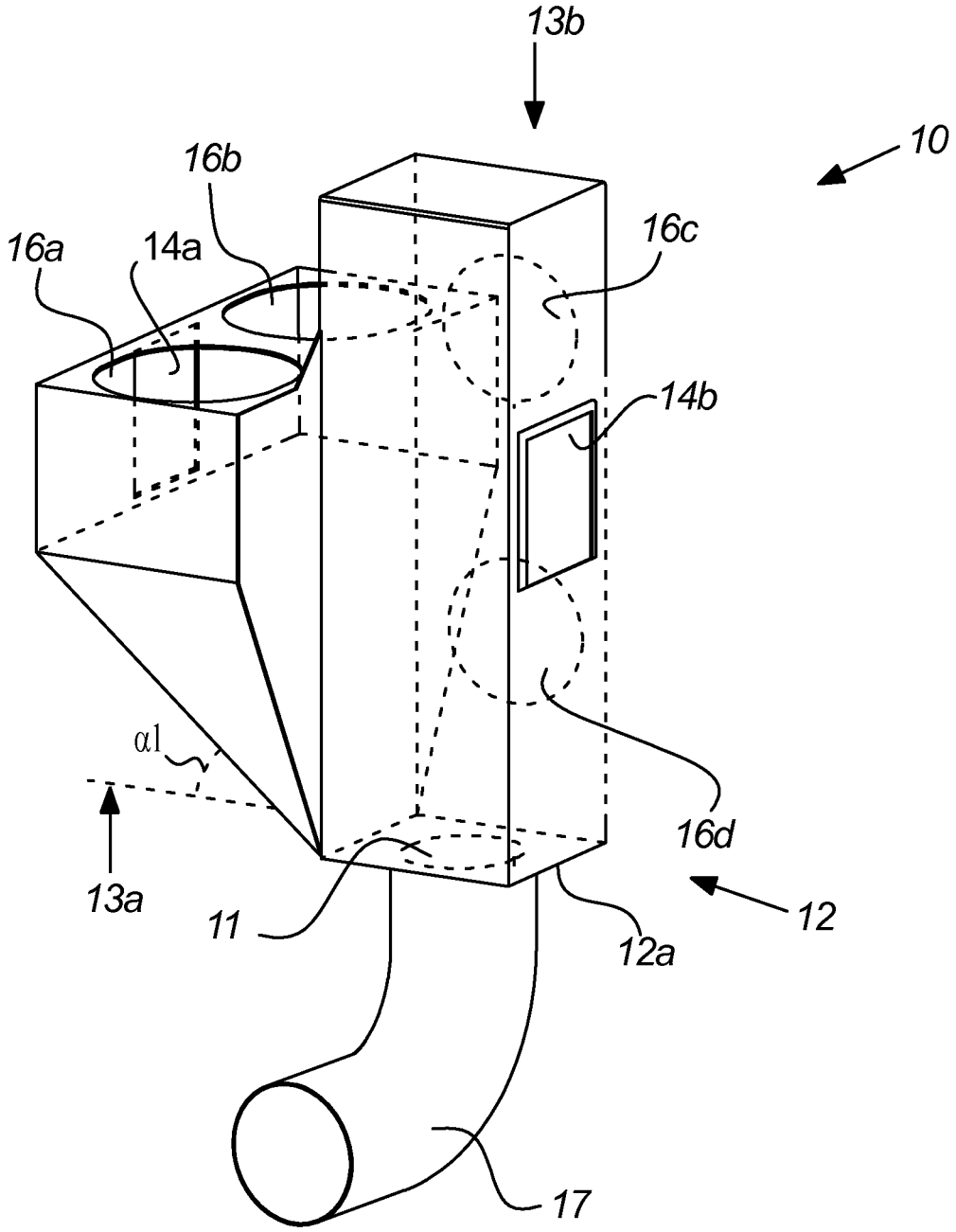
FIG. 2: illustrates an embodiment of a cover for an apparatus for processing fur, seen in perspective according to embodiments of the invention.

FIG. 2 illustrates a preferred embodiment of the cover 10 according to aspects of the invention, seen in perspective. As indicated, the cover 10 comprises openings 16*a*-16*d* for allowing the scraper means (not illustrated in FIG. 2, see e.g. FIG. 1) of the apparatus 1 to be arranged in the compartment 13 of the cover 10 so that it/they may scrape the skin side of the fur on the part of the mandrel that is located in the compartment of the cover 13.

In the present example, the first and second openings 16*a*, 16*b* are arranged to allow the scraping rollers 4*a*, 5*a* of the first set of scraping units 4, 5 to be arranged in the first compartment section 13*a* of the compartment. Also, the third and fourth openings 16*c*, 16*d* are arranged to allow the scraping means 8*a* of the second set of scraping units 8 to be arranged in the second compartment section 13*b* of the compartment 13.

It is naturally understood that the number of sections 13*a*, 13*b* of the cover 10, and/or number of openings 16*a*-16*d* allowing scraping means to be arranged to scrape the skin on the mandrel may be varied dependent on the number and configuration of scraping means of the apparatus 1.

Also, in an embodiment of the invention (not illustrated in any figures), one or more of the drive means for driving the scraping means may be arranged inside the compartment.

As can be seen from FIG. 2, the first and second openings 16*a*, 16*b* may be arranged at the same side of the cover 10 (in the present example in a top wall of the cover), and the third and fourth openings 16*c*, 16*d* may be arranged at the same side of the cover (in the present example in a side wall of the cover). Also, in embodiments of the invention, the first and second openings 16*a*, 16*b* may both be arranged in a bottom part of the cover.

The scraping means of the scraping units may thus be easier to access due to that the scraper means of a set of scraper units may be accessed from the same side. For this purpose, in embodiments of the invention, the scraper units of a set of scraper units comprising scraping means and drive means for operating the scraping means of the unit, may thus be connected to a common support frame part (not illustrated) of the apparatus. This support frame part comprising a set of scraper units may in embodiments of the invention be arranged to be removed from the apparatus together with the scraping unit(s) during e.g. service and/or exchange of the scraping means.

Alternatively, the first and second openings 16*a*, 16*b* may be arranged on opposite sides of the cover 10, and/or the third and fourth openings 16*c*, 16*d* may be arranged at the opposite sides of the cover. This naturally depend on the orientation/arranging of the scraper units 4, 5, 8, 9, and may especially depend on the orientation and/or arranging of the drive means for rotating/operating the scraping means.

As can be seen from FIG. 2, the cover comprises an outlet 11 for removed material. The outlet 11 is preferably arranged at the bottom part 12 of the cover 10 such as in e.g. a bottom plate 12*a* of the cover, leading to the exterior of the cover 10. However, the outlet 11 may in aspects be arranged in any suitable position in the bottom part of the cover.

The outlet 11 is preferably arranged to be in fluid communication with a removal arrangement (not illustrated in FIG. 2) by means of a piping system 17. The removal arrangement may thus be connected to the outlet 11, e.g. by means of the piping system 17 and may thus, during operation, remove material scraped off the skin side of the fur 2 by means of the scraping means 4*a*, 4*b*, 5*a*, 5*b* of the apparatus 1 from the bottom part 12 of the cover 12.

The outlet 11 for the removed material may in embodiments of the invention be arranged to be common to material removed by means of two or more scraping means of the apparatus in embodiments where the apparatus comprises more than one scraper means.

The removal arrangement may e.g. comprise comprises a pump configured for pumping material accumulated at the bottom part to the exterior of the cover. In another embodiment, the removal arrangement may comprise may comprise a suction arrangement connected to the outlet. The suction arrangement may be arranged to establish a vacuum in the cover. The vacuum achieved inside the cover 10 by means of the suction arrangement may in embodiments of the invention be in the range of 0.01-0.9 bar such as between 0.1 and 0.8 bar, for example 0.3-0.7 bar. The suction arrangement may thus, beyond removing the removed material from the cover, also facilitate an advantageous air flow down through the compartment 13 towards the outlet 11 for the removed material.

The apparatus 1 may be configured for scraping the skin side of a plurality of tubular furs 2. Hence, a preferred embodiment of the process of scraping a fur may be as follows:

A fur is arranged so that the skin side of the fur faces outwards and the fur side of the fur faces inwards towards the mandrel 3. The mandrel 3 is then moved in its movement direction MD through the first opening 14*a* (see FIG. 1), through the compartment 13 of the cover 10 and out on the other side of the cover 1 through the second opening 14*b*. The scraping means 4*a*, 5*a*, 8*a* of the scraper units of the apparatus scrapes the skin side of the fur inside the compartment when the skin side pass the scraper means during this movement of the mandrel 3. The material removed from the skin side by means of this scraping is lead towards the bottom part 12 of the cover 1 by means of among others the inner surfaces of the cover as described in more details later on. The fur may then e.g. be removed from the mandrel when the mandrel has entered through the second opening 14, and the mandrel 3 is then pulled back through the compartment 13 and out through the first opening 14*a*. Hence a new fur can be arranged on the mandrel and the process can be repeated.

One or more of the walls of the cover are thus preferably arranged to extend so as to lead the material towards the bottom part. For example, one or more of the side walls, bottom walls and/or top walls of the cover may thus extend in a vertical direction and/or incline towards the outlet by being arranged with an angle $\alpha$1 in relation to the horizontal plane as seen in e.g. FIG. 2. E.g. by an angle of between 5° to 85 in relation to horizontal e.g. between 10° to 70° in relation to horizontal such as between 20° to 60° in relation to horizontal.

The walls forming the cover 10 may e.g. be made of one or more plates of any suitable material. For example, the plates of may e.g. be made from a metal, a composite material, a polymer material and/or the like.

Figure 3:
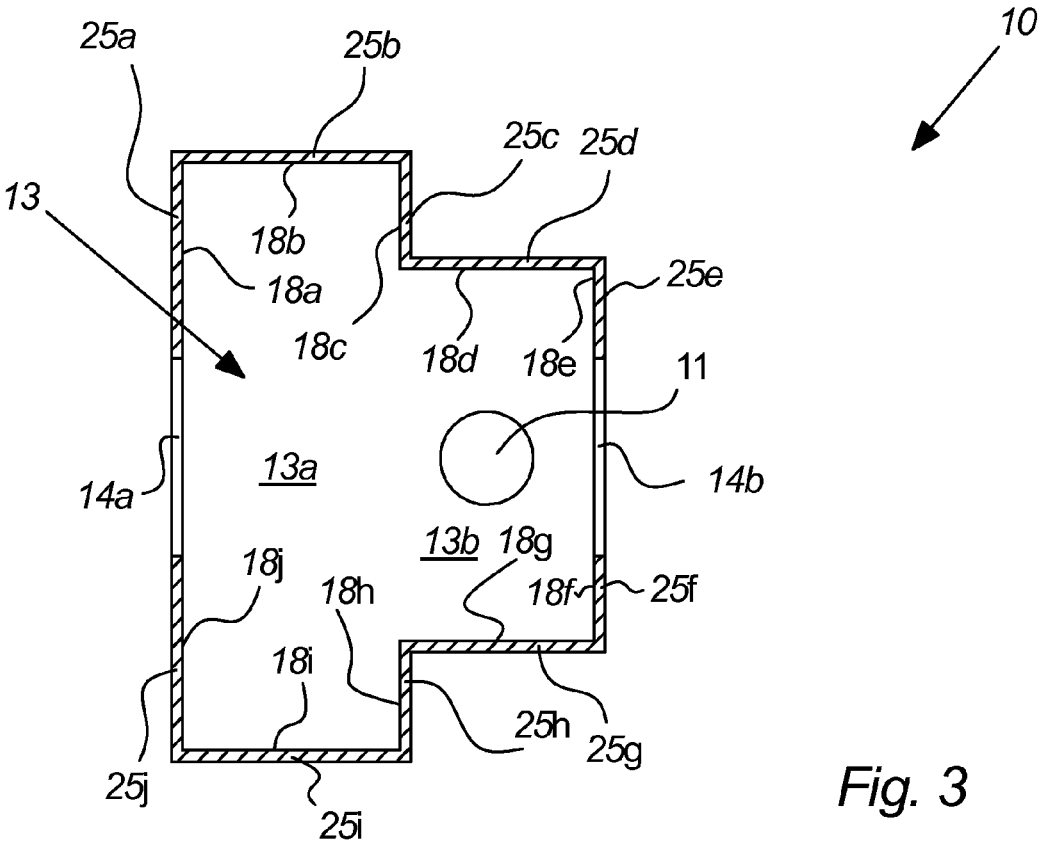
FIG. 3: illustrates a view of an embodiment of a cover seen from above and with a view into a part of the interior of the cover according to embodiments of the invention.

FIG. 3 illustrates a view of the cover 10 seen from above and with a view into a part of the interior of the cover 10. The cover 10 may comprise a plurality of side walls 25*a*-25*j* defining inner surfaces such as the surfaces 18*a*-18*j* forming the compartment 13. A plurality of these surfaces 18*a*-18*j* of the side walls preferably leads in a direction towards the outlet 11 in the bottom part of the cover 12, so that when the cover 10 is arranged on the apparatus 1, material that has be scraped off the skin side of the fur on the mandrel, and that is hereby hurled and/or drips onto these surfaces is lead towards the lower part of the cover and towards the outlet by means of gravity.

As illustrated in FIG. 2, the cover 2 also comprises upper walls and bottom walls so as to form a substantially closed cover 1.

Figure 4:
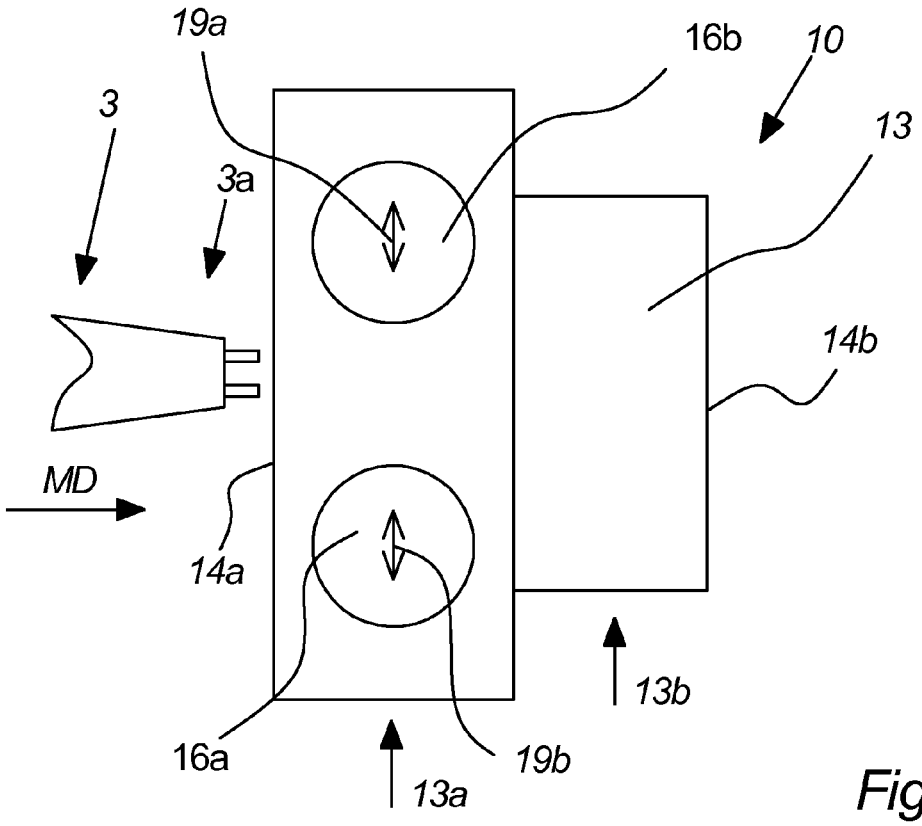
FIG. 4: illustrates an embodiment of a cover for an apparatus for processing fur seen from above according to embodiments of the invention.

FIG. 4 illustrates an embodiment of the cover 10 seen from above. In FIG. 4, the first and second openings 16*a*, 16 *b* allowing the scraper means 4*a*, 5*a*, e.g. scraper rollers (not illustrated in FIG. 4), of the first set of scraping units 4, 5 to be arranged in the compartment 13 to scrape the skin side of the part of a fur 2 covering side surfaces of the mandrel 3. The openings 16*a*, 16*b* each allow a certain amount of displacement of the scraping roller towards and away from the mandrel during operation as indicated by the arrows 19*a*, 19*b*. this facilitates that the scraping means 4*a*, 4*b* may be arranged to scrape side surfaces of the mandrel 3, and may e.g. furthermore be arranged away from the mandrel 3, e.g. when the scraping of the skin side of the fur is finished and the mandrel is pulled back in a direction towards its second part 3*b* to a position where a new fur can be arranged on the mandrel for scraping.

It is understood that e.g. the third and fourth openings 16*c*, 16*d* for allowing the scraping means 8*a* of the second set of scraping units 8 to be arranged in the compartment 13 may be arranged in a similar way to allow the scraping means to be moved towards and away from the mandrel 3. Also, FIG. 4 illustrates that the scraping units 4, 5 may be arranged at the same side of the mandrel, and may thus both facilitate scraping skin on the side surfaces on the mandrel through openings in a top wall of the cover.

Figure 5:
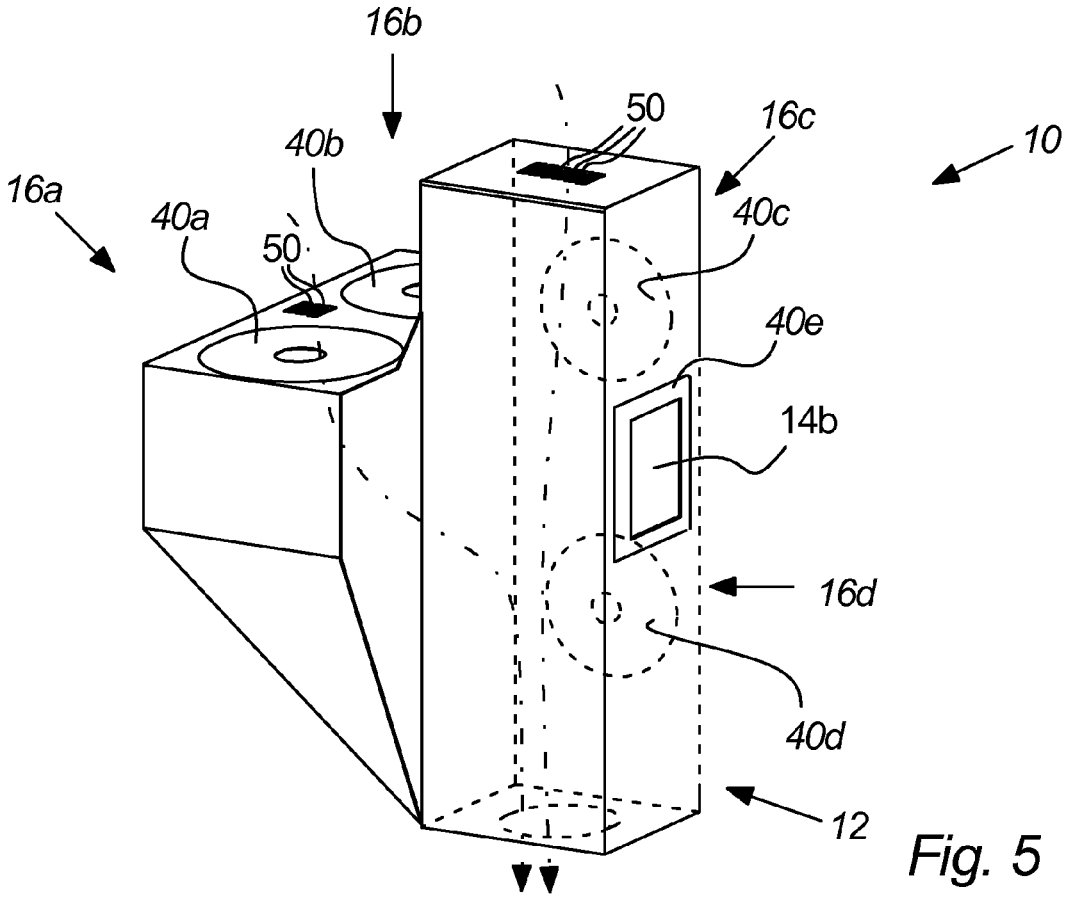
FIG. 5: illustrates an aspect of the invention where openings of a cover comprises tightening arrangements according to embodiments of the invention

FIG. 5 illustrates an aspect of the invention where one or more of the openings 16*a*-16*d*, and preferably also the openings 14*a*, 14*b* comprises one or more tightening arrangements 40*a*, 40*b*, 40*c* 40*d*, 40*e* facilitating that scraping means and the part of the mandrel that is arranged inside the compartment 13 are enclosed more firmly in the cover 10 e.g. so as to e.g. facilitate a more controlled flow of air in the compartment, and/or an increased vacuum in the compartment by means of a removal arrangement as earlier described.

The tightening arrangements 40*a*-40*d* for the openings 16*a*-16*d* may thus allow scraping means 4*a*, 5*a*, 8*a* such as scraping rollers to be arranged in the interior of the cover 10, and may also allow the scraping means to be moved towards and away from the mandrel as explained above. the tightening means 40*a*-40*d* may e.g. be arranged to be substantially in abutment with a part of the scraping units 4, 5, 8, 9, e.g. a part connecting the scraping means and the drive means driving the scraping means. For example, the tightening arrangement may comprise a gasket sealing the gap between the edge(s) of the opening and the shaft of the drive means that preferably comprises an electric motor. The tightening means 40*a*-40*e* may e.g. be made from a suitable polymer material, and may e.g. in embodiments of the invention be made from a flexible material such as a rubber material and/or the like.

The apparatus 1 may in embodiments comprise a scraping arrangement, e.g. fixed to the edges 15 of the openings, so as to scrape the skin side of the fur, when the fur is moved through the opening 14*b*, and/or so as to scrape the surface of the mandrel when the mandrel is pulled back through the cover. This may help to remove material that may have been scraped of the skin side of the fir by means of scraper means 4*a*, 5*a*, 8*a*, but that may stick to the skin and/or the mandrel after the scraping. In FIG. 5, the tightening means 40*e* also constitute such a scraper arrangement, but it is understood that the scraping arrangement may alternatively be arranged after the scraper means 4*a*, 5*a*, 8*a* at a suitable location inside the cover in other embodiments. The scraper arrangement may e.g. comprise fixed scraper edges e.g. as illustrated in FIG. 5 by the ref 40*e* arranged to scrape the surface of the skin side and/or the surface of the mandrel.

The cover 10 may comprises one or more service openings configured for allowing access to the scraping means. Such service openings are preferably configured for being sealed during operation of said apparatus. For example the openings 16*a*-16*d* in the cover sealed by the above tightening arrangement(s) mentioned above may be removed and the openings may hence have a size allowing the scraper means to be removed from the interior of the cover through the opening(s) in the cover. Alternatively or additionally, the cover may comprise one or more gates/doors (not illustrated) to be opened during service and/or the like.

Furthermore, the cover 10 may in embodiments of the invention comprise one or more ventilation openings 50 in the walls of the cover. These ventilation openings may acts as air inlets for air from different areas of the cover 13. These ventilation openings 50 are preferably separate to the one or more openings 14*a*, 14*b* allowing the mandrel 3 to be moved in its longitudinal direction LD through the compartment 13 of the cover 10, and openings 16*a*-16*d* for facilitating that the scraping means may be arranged in the compartment 13 of the cover 10. The ventilation openings 50 may thus acts as inlets for air from the exterior of the cover 10. The air thus enters the ventilation openings 50 and is lead through the compartment 13 towards the outlet 11 in the bottom of the cover as indicated by the dash-dotted lines by means of the removal arrangement. The ventilation openings 50 may e.g. be arranged in the upper part of the cover 10 such as in top walls of the cover and/or in upper parts of side walls of the cover 10 so as to facilitate a flow of air down through the compartment 13 to the outlet 11. In embodiments of the invention, one or more of the ventilation openings 50 is/are arranged at a higher location than the scraping means such as e.g. at a location above one or more of the openings 16*a*-16*f* when the cover 10 is arranged on the apparatus 1. However, in general, the ventilation openings 50 may in embodiments of the invention be arranged at any suitable location in the walls of the cover 10.

Figure 6:
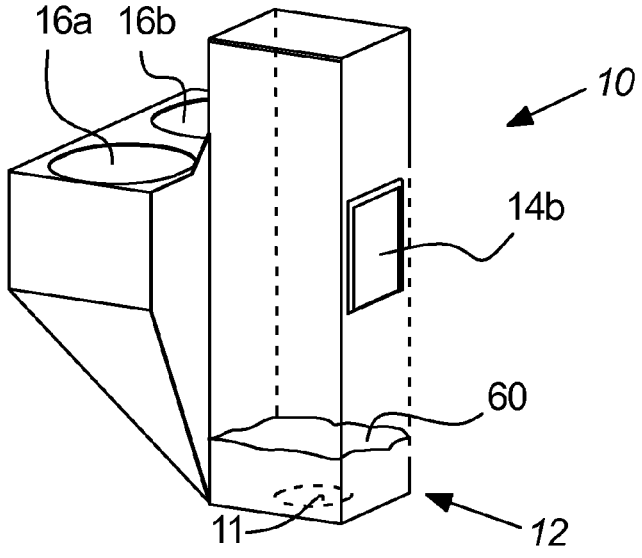
FIG. 6: illustrates an embodiment of the invention wherein a bottom part of the a cover is configured for acting as a temporary storage for material removed from the skin side of furs, according to embodiments of the invention

FIG. 6 illustrates an embodiment of the invention wherein the bottom part 12 of the cover is configured for acting as a temporary storage for material removed from the skin side of a plurality of furs 2. During the scraping of a plurality of tubular furs, the material removed material will move towards the bottom part 12 of the cover 10 by means of e.g. gravity, a suction arrangement arranged for establishing a vacuum inside the cover and/or the like. The material may then accumulate in the bottom part 12 of the cover where it may e.g. be retained in the cover by means of e.g. a bottom wall and side walls of the cover. The accumulated material 60 may then, e.g. once in a while, be removed from the storage by means of the removal arrangement. E.g. a pump connected to the outlet 11 of the cover 1. The removal arrangement may e.g. be arranged to be in operation continuously when the apparatus is in operation, it may be controlled based on sensors for sensing the amount of accumulated material, it may be arranged to operate with a predetermined time interval and/or the like.

Figure 7:
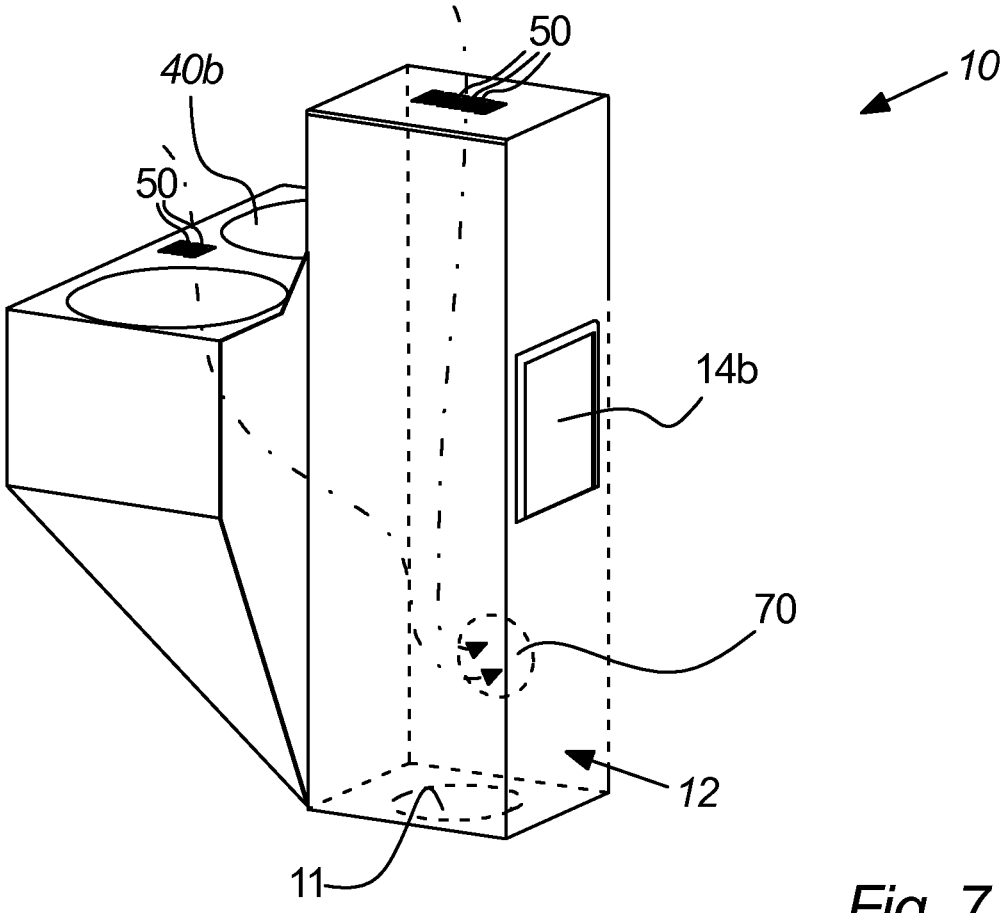
FIG. 7: illustrates an embodiment of a cover comprising two outlets according to embodiments of the invention.

FIG. 7 illustrates an embodiment of the invention wherein the cover comprise both an outlet for material removed from the skin side of the fur, and an air outlet 70. The air outlet 70 is in the present example separate to the outlet 11 for the removed material. Thus, in the present example, the apparatus 1 may comprise a first removal arrangement connected to the outlet for the material 11, and a second removal arrangement connected to the air outlet 70. The second removal arrangement may e.g. be a suction arrangement. Thus, air may be sucked into the compartment of the cover by means of one or more air inlets, e.g. air inlets 50 as illustrated and described above, but air may also be sucked into the compartment 13 through one or more of the openings 16*a*, 16*b*, 16*c*, 16*d*, 14*a*, and/or 14*b* (see e.g. FIGS. 1-5) in embodiments of the invention and/or other openings in the cover.

As seen in FIG. 7, the air outlet 70 may be located at a higher position than the outlet for the material 11, but in other embodiments, the air outlet may be located at any suitable position in the cover.

In embodiments of the invention, the cover may further more comprise a separation arrangement arranged for separating the removed material from the suction air. This may e.g. be facilitated by an impingement separator arrangement and/or a sedimentation separator arrangement, e.g. arranged in front of and/or above the outlet 70. The separation arrangement may help to prevent that material removed from the skin side enters to the exterior of the cover through the air outlet 70. Also, the separation arrangement may in aspects of the invention be arranged so that the material collected/intercepted and/or retained by the separation arrangement can fall into the bottom part of the cover 12.

In the embodiment(s) of FIG. 7, the bottom part 12 may advantageously be arranged to comprise a part acting as a temporary storage for removed material e.g. as described in relation to FIG. 6. The outlet 11 may thus be connected to a pump for removing material from the bottom part 12 through said outlet 11 for the material.

In general, it is to be understood that the invention is not limited to the particular examples described above but may be adapted in a multitude of varieties within the scope of the invention as specified in the claims.

For example, in embodiments of the invention, the apparatus may comprise a mandrel being arranged to rotate around its center axis, and one or more scraping units comprising scraping means may e.g. be arranged to be moved in the longitudinal direction of the mandrel to scrape the skin side of a fur arranged on the mandrel while the mandrel rotates. Such embodiments are however not illustrated in this document.

Furthermore, it is to be understood that two or more embodiments and/or features illustrated in one or more figures may also be combined in a multitude of varieties to achieve different embodiments not directly described in this document.

The invention claimed is:

1. An apparatus for processing the skin side of a tubular fur, which apparatus comprises:

a mandrel on which the tubular fur can be drawn from a first part of the mandrel towards a second part of the mandrel so that the skin side of the fur faces outwards and the fur side of the fur faces inwards towards the mandrel, one or more scraper units, each scraping unit comprising at least one scraper roller configured for scraping said skin side when the fur is arranged on the mandrel, wherein the at least one scraper roller comprises a plurality of scraping edges for scraping the skin side of the fur during rotation and when in contact with the skin side, and a cover comprising a compartment and an outlet, wherein said cover is configured for enclosing at least a part of said mandrel and at least one of said at least one scraper roller in said compartment during operation, wherein said outlet is arranged in a bottom part of said cover, said bottom part being arranged below said at least one scraper roller, and wherein said cover comprises walls with inner surfaces configured for leading material removed from said skin side by means of one or more of said one or more scraper rollers towards said bottom part, wherein the at least one scraper roller is arranged to be moved towards and away from said mandrel during operation, and wherein said cover comprises at least one opening allowing the at least one scraper roller to be moved towards and away from said mandrel during operation of said apparatus.

2. An apparatus according to claim 1, wherein said apparatus comprises a removal arrangement, said removal arrangement being configured for removing said material removed from said skin side from said bottom part.

3. An apparatus according to claim 2, wherein said removal arrangement comprises a pump arrangement connected to said outlet and being configured for pumping said material from said bottom part to the exterior of said cover.

4. An apparatus according to claim 2, wherein said removal arrangement comprises a suction arrangement connected to the bottom part of said cover.

5. An apparatus according to claim 1, wherein said cover is kept in a fixed position during operation.

6. An apparatus according to claim 1, wherein said at least one opening comprises one or more tightening arrangements arranged for sealing a gap between said scraping unit and a wall of the cover.

7. An apparatus according to claim 1, wherein said apparatus comprises a first set of scraping units with scraper rollers arranged at opposite sides of the mandrel for scraping the skin side of the fur arranged on side surfaces of the mandrel when the mandrel is moved in its movement direction, and wherein the apparatus comprises a second set of scraping units comprising scraper rollers for scraping the skin side of the fur arranged on top and bottom surfaces on the mandrel.

8. An apparatus according to claim 7, wherein said compartment of said cover is common to the scraper rollers.

9. An apparatus according to claim 1, wherein said compartment of said cover is common to scraper rollers of two or more scraping units of the apparatus.

10. An apparatus according to claim 1, wherein said apparatus comprises at least one set of scraper rollers arranged on opposite sides of said mandrel, and wherein said cover is arranged to enclose the scraper rollers of at least one of said set of scraping units in said compartment.

11. An apparatus according to claim 1, wherein said cover is common to all scraper rollers of said apparatus.

12. An apparatus according to claim 1, wherein said cover comprises one or more service openings configured for allowing access to said one or more scraper rollers, said one or more service openings being configured for being sealed during operation of said apparatus.

13. An apparatus according to claim 1, wherein said cover comprises openings for allowing said mandrel to be moved in its longitudinal direction through said compartment of the cover so as to allow said one or more scraper rollers to scrape said skin side of the fur.

14. An apparatus according to claim 1, wherein said cover comprises one or more ventilation openings for air, said ventilation openings being separate to one or more openings configured for allowing said mandrel to be moved in its longitudinal direction through the compartment of said cover, and/or openings for facilitating that said one or more scraper rollers can be arranged in the compartment of the cover.

15. An apparatus according to claim 14, wherein one or more of said one or more ventilation openings is/are arranged at a higher location than said scraper rollers.

16. An apparatus according to claim 1, wherein the drive arrangement(s) of a set of scraping units comprising scraper rollers arranged on opposite sides of the mandrel are arranged on the same side in relation to the mandrel.

17. An apparatus according to claim 1, wherein said bottom part is configured for acting as a temporary storage for material removed from said skin side.

18. An apparatus according to claim 1, wherein said cover comprises a second outlet being an air outlet separate to said outlet.

19. An apparatus for processing the skin side of a tubular fur, which apparatus comprises:

a mandrel on which the tubular fur can be drawn from a first part of the mandrel towards a second part of the mandrel so that the skin side of the fur faces outwards and the fur side of the fur faces inwards towards the mandrel, a first set of scraping units with scraper rollers arranged at opposite sides of the mandrel for scraping the skin side of the fur arranged on side surfaces of the mandrel when the mandrel is moved in its movement direction, and a second set of scraping units comprising scraper rollers for scraping the skin side of the fur arranged on top and bottom surfaces on the mandrel, wherein said scraper rollers comprises a plurality of scraping edges for scraping the skin side of the fur during rotation and when in contact with the skin side, and a cover comprising a compartment and an outlet, wherein said cover is configured for enclosing at least a part of said mandrel and said scraper rollers in said compartment during operation, wherein said outlet is arranged in a bottom part of said cover, said bottom part being arranged below said at least one scraper roller, and wherein said cover comprises walls with inner surfaces configured for leading material removed from said skin side by means of said scraper rollers towards said bottom part.

20. An apparatus according to claim 19, wherein said cover comprises a plurality of openings allowing said scraper rollers to be moved towards and away from said mandrel during operation of said apparatus.

* * * * *